US007025317B2

(12) United States Patent
Masas

(10) Patent No.: US 7,025,317 B2
(45) Date of Patent: Apr. 11, 2006

(54) METHODS AND APPARATUS FOR SUSPENDING FIXTURES

(76) Inventor: Fernando R. Masas, 100 Astoria Ave., Bridgeport, CT (US) 06604

( * ) Notice: Subject to any disclaimer, the term of this patent is extended or adjusted under 35 U.S.C. 154(b) by 52 days.

(21) Appl. No.: 10/092,741

(22) Filed: Mar. 7, 2002

(65) Prior Publication Data

US 2003/0168563 A1 Sep. 11, 2003

(51) Int. Cl.
*A47F 5/08* (2006.01)

(52) U.S. Cl. ..... 248/317; 248/300; 248/303

(58) Field of Classification Search ..... 248/317, 248/300, 301, 58, 342, 343, 74.1, 74.2, 303, 248/304, 249, 235, 215, 65
See application file for complete search history.

(56) References Cited

U.S. PATENT DOCUMENTS 466,932 A * 1/1892 Cornell
564,468 A * 7/1896 Buell ..... 248/249
1,585,840 A * 5/1926 Fahnestock
1,753,013 A * 4/1930 Lindmark
2,672,314 A * 3/1954 Mitchell ..... 248/301
2,761,714 A * 9/1956 Cuskie ..... 287/85
3,055,625 A * 9/1962 Kopf et al. ..... 248/339
3,214,127 A * 10/1965 Skidmore et al. ..... 248/327
4,358,635 A * 11/1982 Druffel ..... 174/101
4,601,451 A * 7/1986 Leonardo ..... 248/74.1
4,639,219 A * 1/1987 Gagin ..... 433/22
4,673,151 A * 6/1987 Pelz ..... 248/74.1
4,776,809 A * 10/1988 Hall ..... 439/116
4,924,709 A * 5/1990 Plyter ..... 73/829
5,052,648 A * 10/1991 Landau ..... 248/235
5,067,677 A * 11/1991 Miceli ..... 248/68.1
5,149,026 A * 9/1992 Allen ..... 248/68.1
5,184,792 A * 2/1993 Bernhard et al. ..... 248/71
5,346,166 A * 9/1994 Valiulis ..... 248/220.4
5,351,920 A * 10/1994 Decky et al. ..... 248/73
5,664,754 A * 9/1997 Gaenslen ..... 248/317
6,126,493 A * 10/2000 Price et al. ..... 439/801
6,216,320 B1 * 4/2001 Schauermann ..... 24/458
6,382,569 B1 * 5/2002 Schattner et al. ..... 248/74.1
6,477,770 B1 * 11/2002 Dickens ..... 29/868

* cited by examiner

*Primary Examiner*—Ramon O. Ramirez
*Assistant Examiner*—Steven Marsh
(74) *Attorney, Agent, or Firm*—Thomas A. Gallagher

(57) ABSTRACT

The invention includes an angle bracket with a hole for a fastener and a flange for coupling a wire to the angle bracket. The flange is lanced and it is coupled to the wire by crimping. According to a first embodiment of the invention, the flange is provided with two horizontal lances. According to a second embodiment, the flange is provided with at least three alternating horizontal lances. According to a third embodiment, the flange is provided with a horizontal lance and a vertical lance. According to a fourth embodiment, the flange is provided with a vertical lance in the shape of a hook and an eyelet is provided for connecting the wire. According to a fifth embodiment, the flange is wrapped to form a slotted cylinder. The wire is inserted into the slotted cylinder which is then compressed and crimped onto the wire. According to a sixth embodiment, the bracket is provided with two wire connecting flanges. A seventh embodiment combines features of the second and sixth embodiments. A kit according to the invention includes a plurality of brackets, a plurality of pre-cut lengths of wire, and a combined crimping and testing tool.

3 Claims, 9 Drawing Sheets

METHODS AND APPARATUS FOR SUSPENDING FIXTURES

BACKGROUND OF THE INVENTION

1. Field of the Invention

The invention relates to mechanical fasteners. More particularly, the invention relates to mechanical fasteners suitable for suspending fixtures such as acoustic tile ceilings, pipes, lighting fixtures, electrical cables, HVAC equipment etc.

2. State of the Art

Current practice in the construction trade and building industry is to suspend fixtures with wires which are fastened to a wall or ceiling. An example of a state of the art apparatus for suspending fixtures is illustrated in prior art FIG. 1. The apparatus generally includes an angle bracket 10 having two holes 12, 14, a fastener 16 (typically a nail or a screw), and a length of wire 18 (often six to eight feet long). The method for using the apparatus includes attaching the wire 18 through one of the holes 14, inserting the fastener 16 through the other hole 12, and fastening the fastener 16 to a wall or ceiling 20. An exemplary bracket and fastener are illustrated in U.S. Pat. No. 5,178,503 and U.S. Pat. No. 4,736,923.

The apparatus shown in FIG. 1 is often used to suspend fixtures from cement, stone, or other masonry material ceilings, typically in commercial buildings. The wires 18 are attached to ceiling tile grids, pipe brackets, HVAC ducts, lighting fixtures, etc. Because a relatively large variety of equipment is hidden above a suspended acoustic tile ceiling in a commercial building, the wires 18 are often six to eight feet long.

The fastener 16 is usually pre-fit into the hole 12 of the bracket 10 during manufacture. However, the wire 18 (usually 12 gauge galvanized steel) must be manually attached to the bracket 10 by inserting a free end of the wire through the hole 14, looping the wire onto itself and twisting it as shown in FIG. 1. This is often done by hand with a pair of pliers or may be done with the aid of a hand operated (or drill operated) crank such as the "wire tying fixture", item number 00052075, sold by Hilti, Inc., Tulsa, Okla. These methods of attaching the wire to the bracket present several disadvantages.

The most apparent disadvantage is the cost of labor for the labor intensive task of twisting the wire. In order to be reasonably secure and satisfy some municipal codes, approximately eight inches of the wire must be twisted eight to ten turns about itself. In practice, many workers only twist the wire three or four times about itself. Still, the work is time consuming. The best productivity is not much more than about 300 pieces per hour and after about 500 pieces the worker needs to rest.

Another disadvantage is that this method of connecting the wire to the bracket is not very secure. Under a stress of about 50 lbs., the wire loop stretches and under a stress of about 210 lbs. the wire untwists.

Still another disadvantage is that the connection between the wire and the bracket is loose. Under normal circumstances, gravity provides tension between the wire and the bracket. However, in the case of an earthquake or a fire, the loose connection between the wire and the bracket allows vibration and movement of the fixtures supported by the wire. This can result in fixtures falling onto emergency workers and other similar hazards.

SUMMARY OF THE INVENTION

It is therefore an object of the invention to provide improved methods and apparatus for suspending fixtures.

It is also an object of the invention to provide methods and apparatus for suspending fixtures which are not labor intensive.

It is another object of the invention to provide methods and apparatus for suspending fixtures which are more economical than the state of the art.

It is still another object of the invention to provide methods and apparatus for suspending fixtures which are safer and stronger than the state of the art.

In accord with these objects which will be discussed in detail below, the apparatus of the present invention includes an angle bracket with a hole for a fastener and a flange for coupling a wire to the angle bracket. The flange is lanced and it is coupled to the wire by crimping. According to a first embodiment of the invention, the flange is provided with two horizontal lances. According to a second embodiment, the flange is provided with at least three alternating horizontal lances. According to a third embodiment, the flange is provided with a horizontal lance and a vertical lance. According to a fourth embodiment, the flange is provided with a vertical lance in the shape of a hook and an eyelet is provided for connecting the wire. According to a fifth embodiment, the flange is wrapped to form a slotted cylinder. The wire is inserted into the slotted cylinder which is then compressed and crimped onto the wire. According to a sixth embodiment, the angle bracket is provided with two wire connecting flanges. A seventh embodiment is similar to the sixth embodiment with features of the second embodiment.

A kit according to the invention includes a plurality of lanced angle brackets, a plurality of pre-cut lengths of wire, and a combined crimping and testing tool.

The apparatus of the invention is stronger than the state of the art apparatus. Wire crimped to the bracket does not begin to stretch until a stress of approximately 420 lbs. is applied. This is about twice as strong as the looped wire and bracket combination of the prior art. According to the preferred embodiments, only about ¾" of wire is crimped to the bracket. Thus, almost eight inches of wire is saved in each assembly. Using the crimping tool of the invention, a worker can produce 2,000 wire-bracket assemblies per hour, nearly seven times the productivity of the prior art method. In addition, the methods and apparatus of the invention produce consistent results and do not rely on the integrity of the assembly worker to perform the required number of twists. Furthermore, the connection between the bracket and the wire according to the invention is a rigid connection which enhances the safety of the apparatus.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 2:
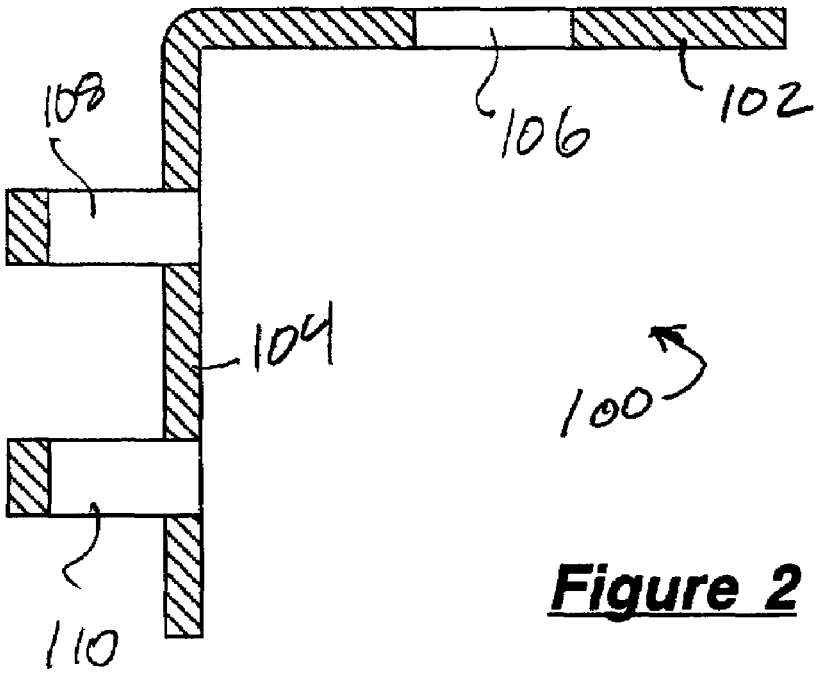
FIG. 2 is a side sectional view of a first embodiment of a bracket according to the invention.
Figure 3:
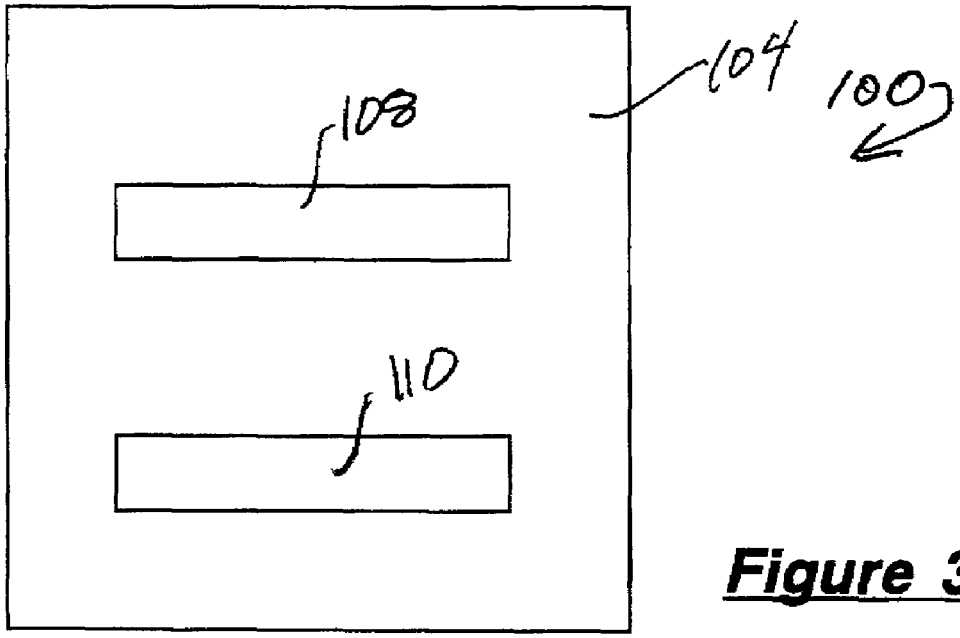
FIG. 3 is a side elevational view of the bracket of FIG. 2.
Figure 4:
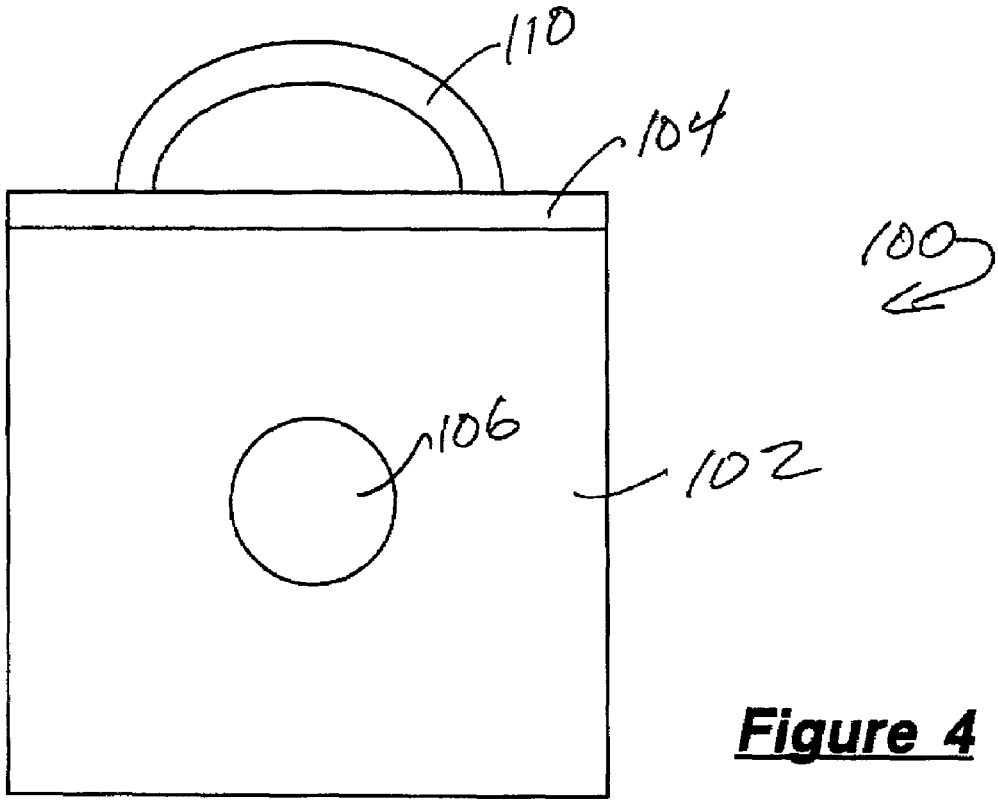
FIG. 4 is a bottom plan view of the bracket of FIGS. 2 and 3.

Referring now to FIGS. 2–4, a first embodiment of the invention includes an angle bracket 100 having a first flange 102 and a second flange 104. The first flange 102 is provided with a hole 106 for receiving a fastener such as a nail (not shown). The second flange 104 is lanced in two places to provide loops 108, 110 which are dimensioned to receive an appropriate wire.

It is intended that the words lance, lanced, and lances be read broadly enough to include any procedure which results in the described structure. Thus, it may be possible, for example, to cast the angle bracket in a single operation which results in the described structure.

Figure 5:
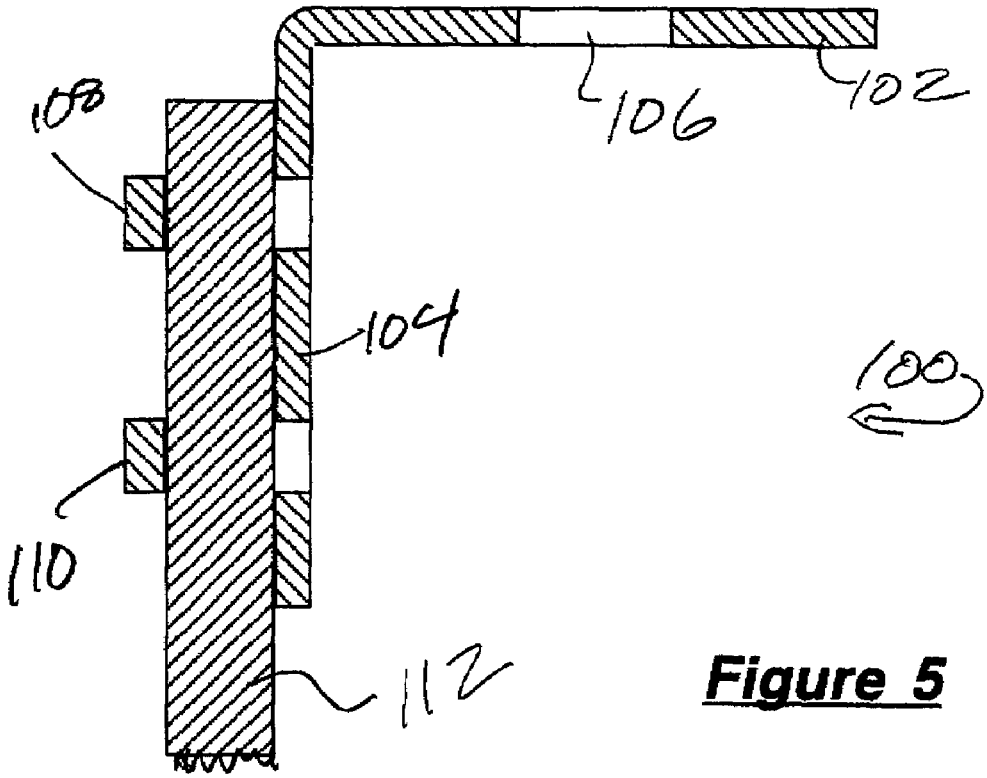
FIG. 5 is a side sectional view of the bracket of FIGS. 2–4 with a wire attached to it.

FIG. 5 illustrates the first embodiment 100 with a wire 112 inserted into the loops 108, 110 and the loops crimped tight against the wire.

It will be appreciated that the method of using the apparatus of the invention includes inserting the end of the wire through the loops, crimping the loops, inserting a fastener through the hole, fastening the bracket to a surface with the fastener, attaching the other end of the wire to a fixture.

Figure 6:
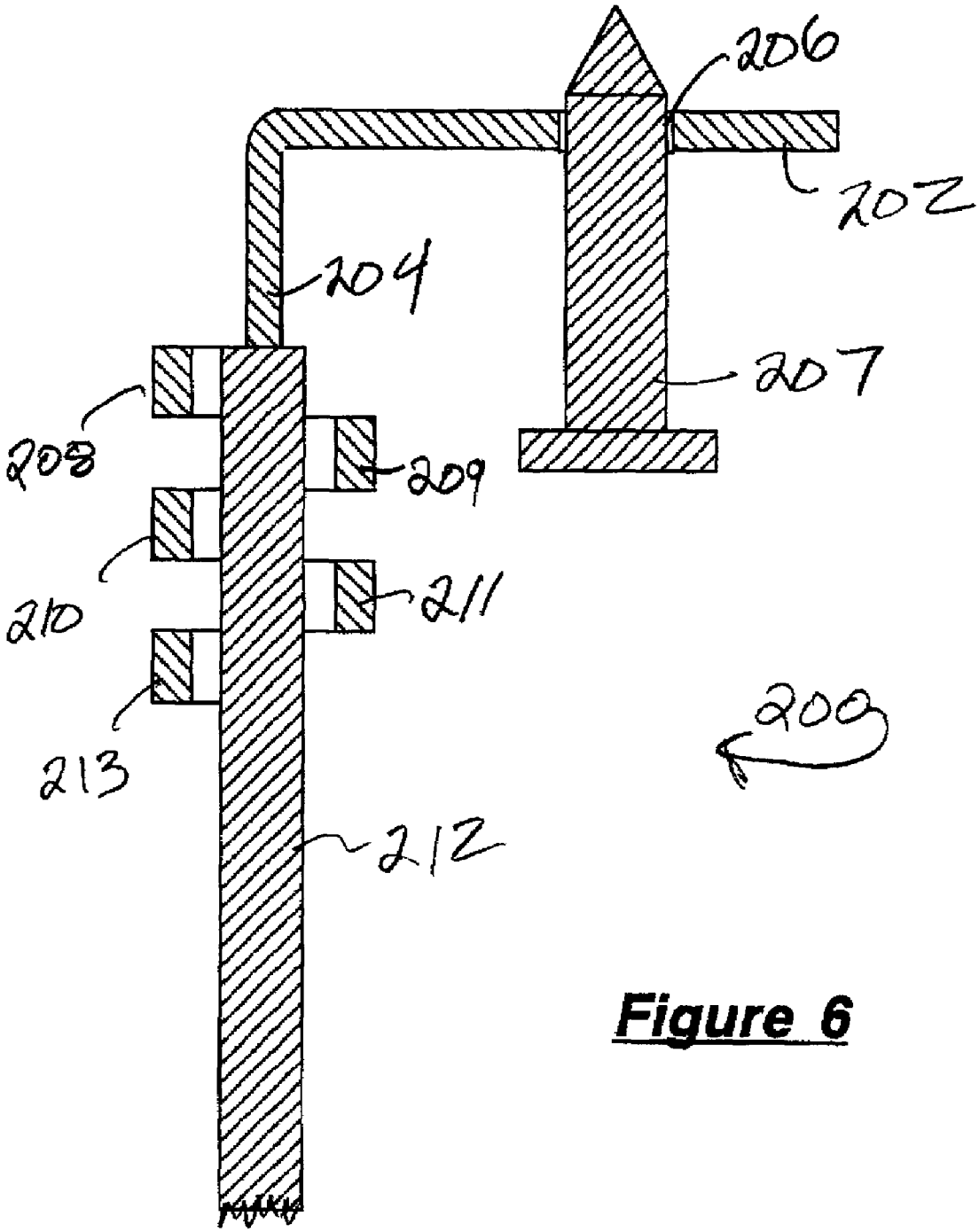
FIG. 6 is a view similar to FIG. 5 of a second embodiment of a bracket according to the invention with a wire inserted but prior to crimping.

FIG. 6 illustrates a second embodiment of the invention. The second embodiment includes an angle bracket 200 having a first flange 202 and a second flange 204. The first flange 202 is provided with a hole 206 for receiving a fastener such as a nail 207. The second flange 204 is lanced in at least three places to provide loops 208, 209, 210, 211, and 213. The loops are alternated in opposite directions. FIG. 6 shows a wire 212 inserted through the loops. It will be appreciated that in this embodiment, because of the alternating loops, the flange 204 stops the wire 212 from passing beyond the upper loop 208.

Figure 7:
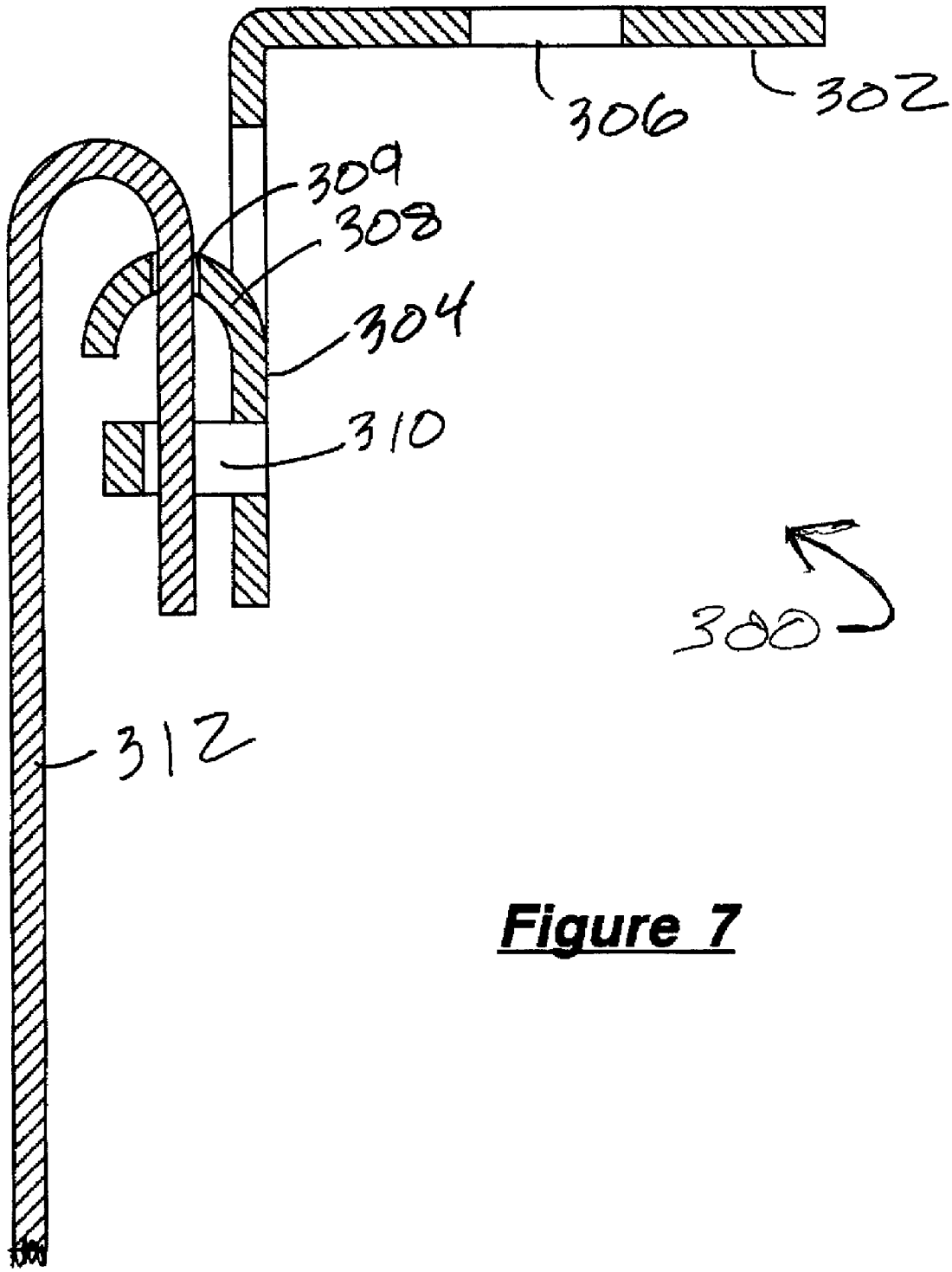
FIG. 7 is a side sectional view of a third embodiment of a bracket according to the invention with a wire inserted but prior to crimping.

Turning now to FIG. 7, a third embodiment of the invention includes an angle bracket 300 having a first flange 302 and a second flange 304. The first flange 302 is provided with a hole 306 for receiving a fastener (not shown). The second flange 304 is lanced in two places to form a tongue 308 and a loop 310. The tongue 308 is provided with a hole 309 which is dimensioned to receive a wire 312. According to this embodiment, the end of the wire 312 is bent approximately 180° and inserted into the hole 309 and the loop 310. The tongue 308 and the loop 310 are then crimped against the wire 312. It will be appreciated that the tongue 308 and the loop 310 can be crimped against the wire before the wire 312 is bent.

Figure 1:
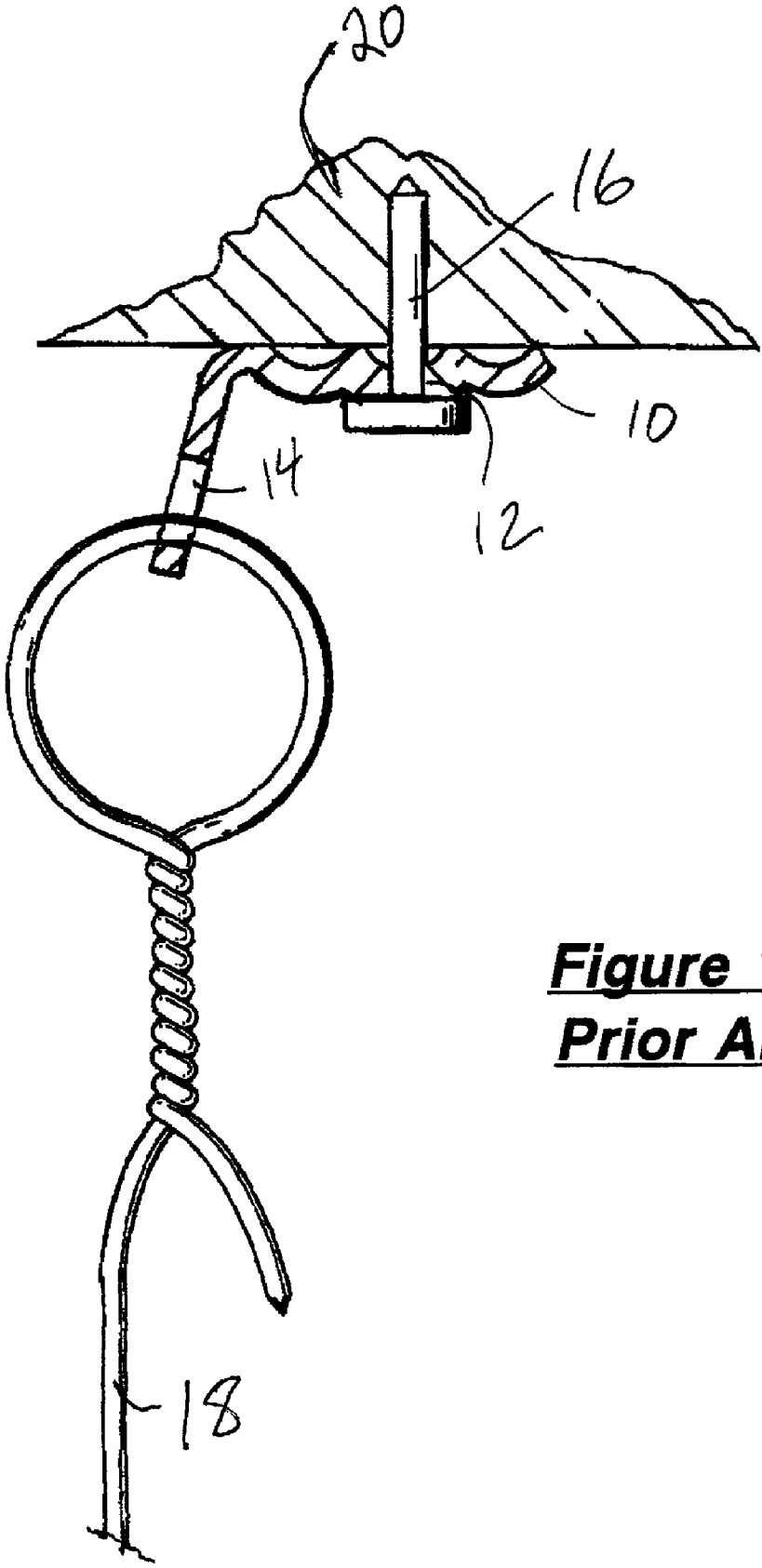
Figure 1 Prior Art
FIG. 1 is a schematic side elevational view, in partial section, of a state of the art apparatus for suspending fixtures.
Figure 8:
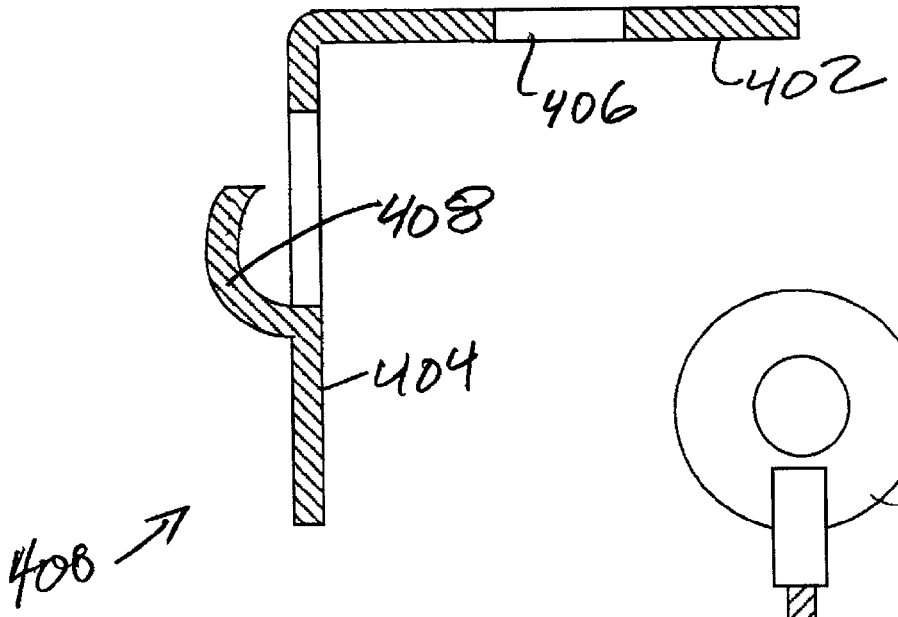
FIG. 8 is a side sectional view of a fourth embodiment of a bracket according to the invention.
Figure 9:
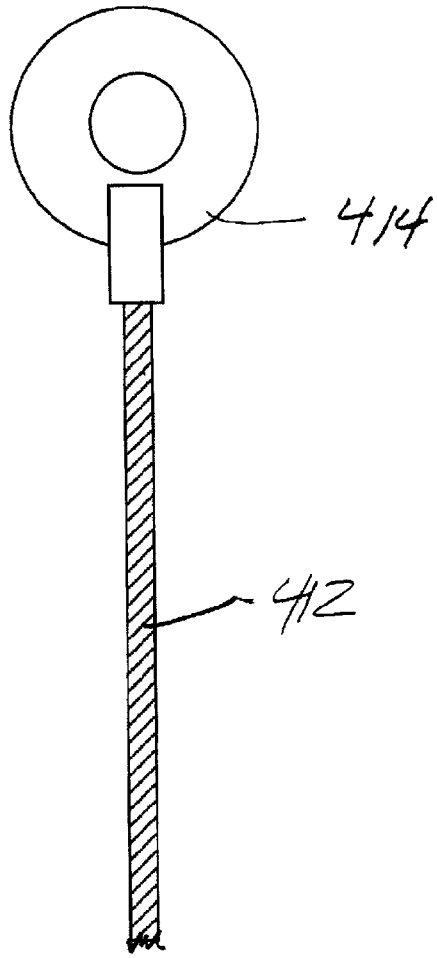
FIG. 9 is a side elevational view of a wire with an eyelet for use with the fourth embodiment of the bracket of the invention.

FIGS. 8 and 9 illustrate a fourth embodiment of the invention. The fourth embodiment includes an angle bracket 400 having a first flange 402 and a second flange 404. The first flange 402 is provided with a hole 406 for receiving a fastener (not shown). The second flange 404 is lanced to form a hook structure 408. As shown in FIG. 9, a wire 412 is coupled to an eyelet 414 by crimping. According to this embodiment of the invention, the eyelet 414 is coupled to the hook 408 and the hook 408 is preferably crimped over the eyelet 414. Those skilled in the art will appreciate that this embodiment could be used with the looped prior art wire 18 shown in FIG. 1. Such a combination would obtain some of the advantages (strength and physical integrity) of the invention but not the other advantages (e.g. ease of use, economy of labor, etc.).

Figure 10:
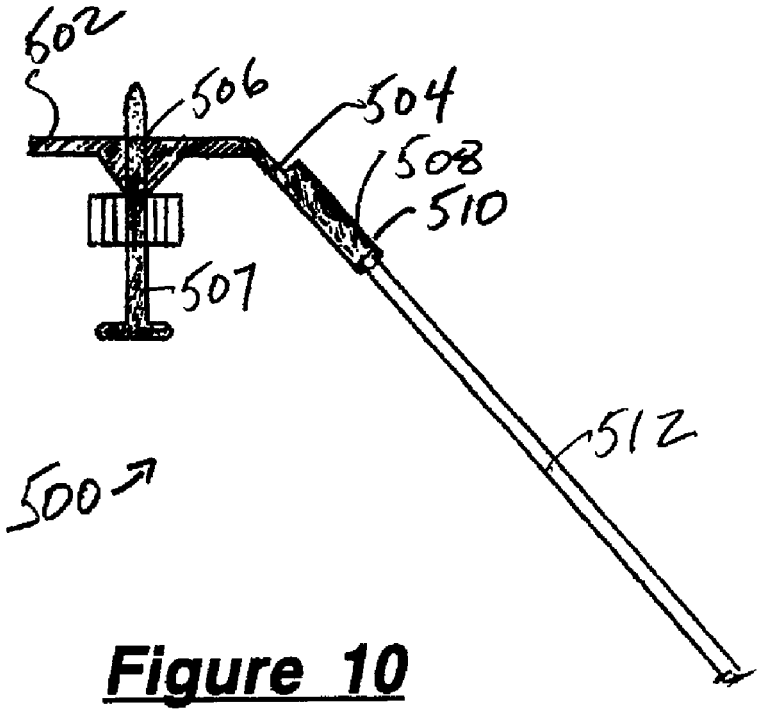
FIG. 10 is a side elevational view in partial section of a fifth embodiment of a bracket according to the invention.
Figure 11:
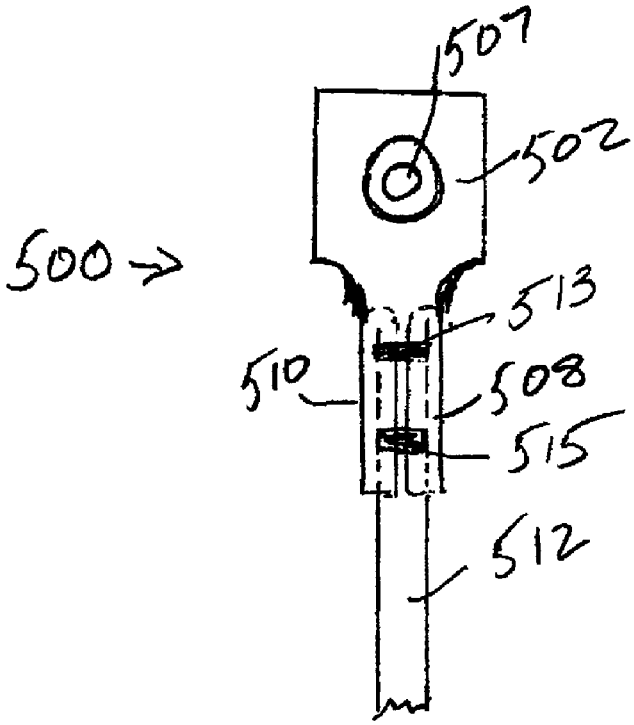
FIG. 11 is a bottom view of the fifth embodiment.

FIGS. 10 and 11 illustrate a fifth embodiment of the invention. The fifth embodiment includes an angle bracket 500 having a first flange 502 and a second flange 504. The first flange 502 is provided with a hole 506 for receiving a fastener such as a masonry nail 507. As illustrated in FIG. 10, structure is provided to secure the nail to the hole so that the bracket 500 can be easily located by an installer using one hand and the nail driven with a tool using the other hand.

The second flange 504 is rolled from two sides 508, 510 to form a slotted cylinder for receiving a wire 512. After a wire 512 is inserted into the cylinder, it is compressed and crimped, e.g. as shown at 513 and 515.

It will be appreciated that the fifth embodiment shows an angle bracket having an approximately 45° angle whereas the previous embodiments illustrated an approximately 90° angle. Those skilled in the art will appreciate that in some applications a 45° angle is preferred over a 90° angle. For example, if a fixture is mounted at opposite sides with 45° angle brackets, the resulting structure will be resistant to lateral movement which might otherwise be caused during an earthquake, for example.

Figure 12:
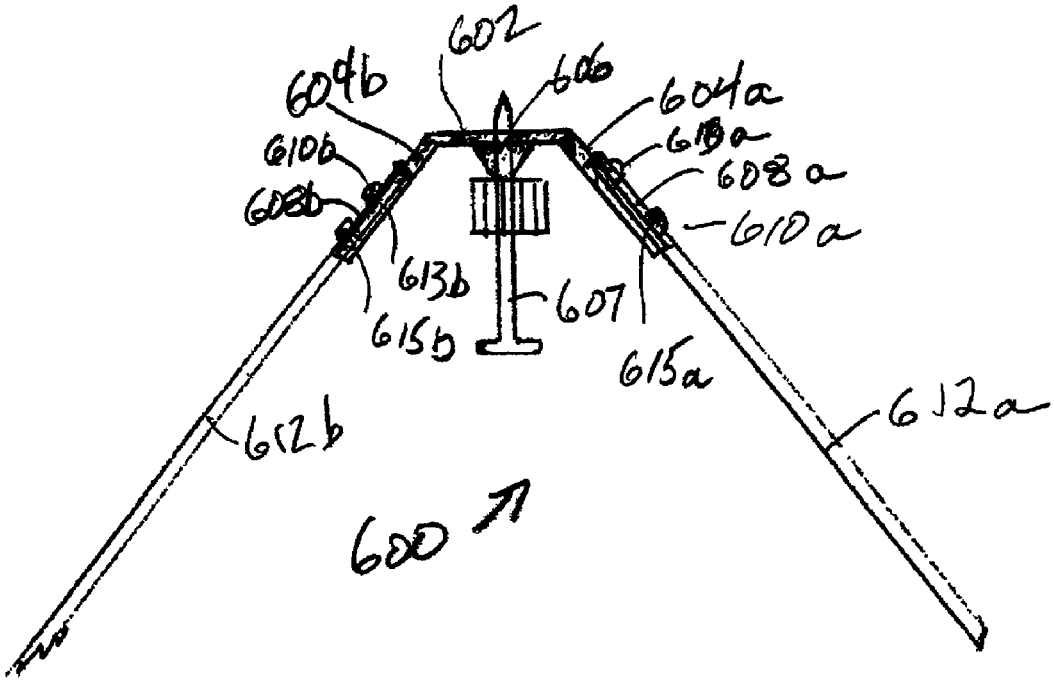
FIG. 12 is a side elevational view in partial section of a sixth embodiment of a bracket according to the invention.

FIG. 12 illustrates a sixth embodiment of the invention which is similar to the fifth embodiment. Similar features of this embodiment are referenced with similar (increased by 100) reference numerals. According to the sixth embodiment a third flange 604*b* is provided on an opposite side of the first flange 602 directly opposed from the second flange 604*a*. This permits two wires 612*a*, 612*b* to be coupled to the angle bracket 600.

According to the invention, it is also possible to provide the angle bracket with additional flanges for coupling three or four or even more wires depending on the configuration of the first flange. For example, the first flange could be shaped as any polygon, thereby determining the maximum number of wire coupling flanges.

Those skilled in the art will appreciate that the masonry nails 607 of the type used in prior art apparatus for suspending fixtures can support more than one thousand pounds. Thus, when suspending a plurality of relatively lightweight fixtures, significant labor reduction can be achieves by using appropriately positioned angle brackets with multiple wires coupled to each bracket.

Figure 13:
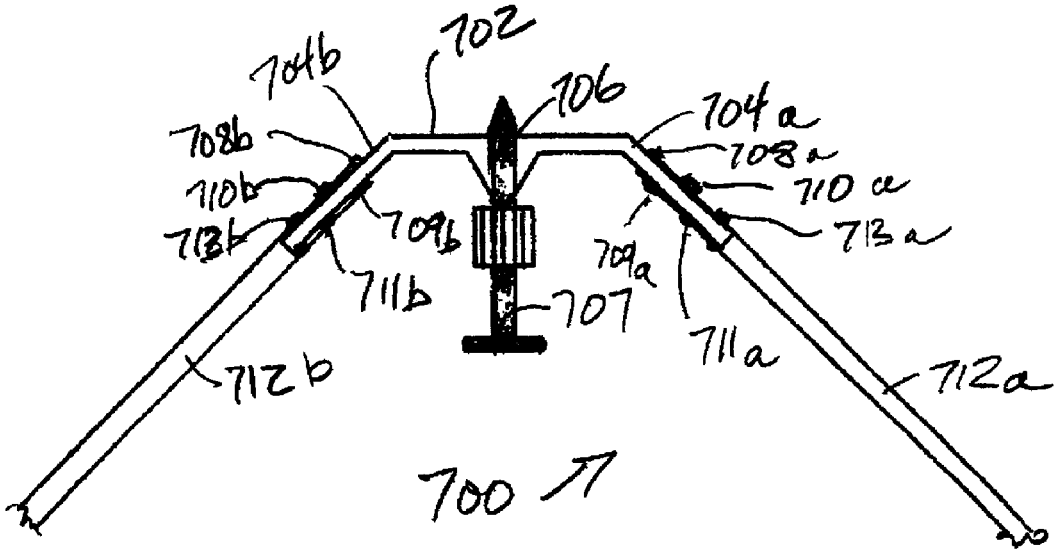
FIG. 13 is a view similar to FIG. 12 of a seventh embodiment of the invention.
Figure 14:
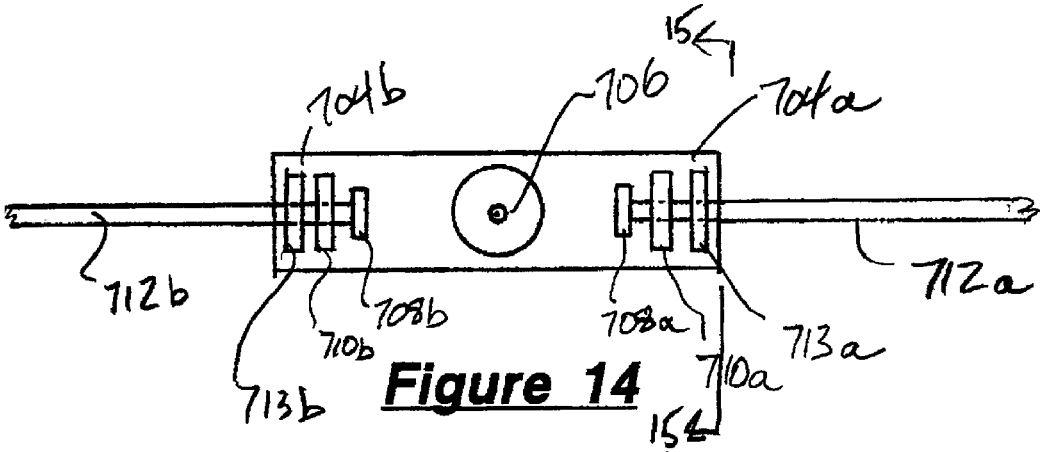
FIG. 14 is a top view of the seventh embodiment.
Figure 15:
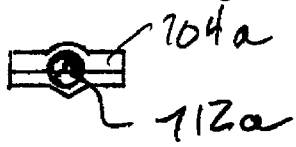
FIG. 15 is a view in the direction 15—15 of FIG. 14.

FIGS. 13–15 illustrate a seventh embodiment of the invention which combines features of the sixth and second embodiment. The reference numerals in FIGS. 13–15 are similar (in their last two digits) to the reference numerals used in FIGS. 6 and 12 and correspond to similar features as those referenced in FIGS. 6 and 12.

Figure 16:
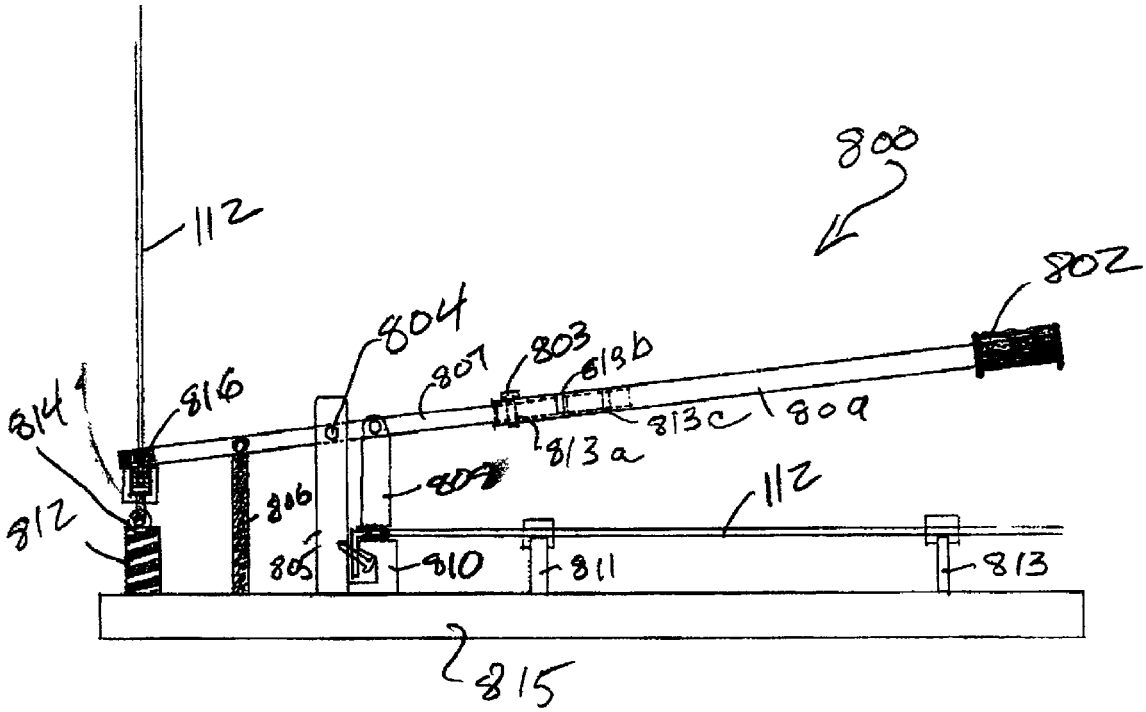
FIG. 16 is a schematic side elevational view of a crimping and testing apparatus according to the invention.

A kit according to the invention includes a plurality of lanced angle brackets, a plurality of pre-cut lengths of wire, and a combined crimping and testing tool. FIG. 16 illustrates a crimping and testing tool 800.

Turning now to FIG. 16, the tool 800 includes a lever 802 coupled by a pivot 804 on a pivot arm 805 which is coupled to a base 815. A spring 806 on one side of the pivot arm 805 holds the lever 802 in a raised position. The lever 802 is provided with a crimping hammer 808 and a crimping anvil 810 is located below the hammer 808. It will be appreciated that by placing the second flange of one of the angle brackets of the invention onto the anvil 810, and pressing down on the lever 802, the hammer 808 will form the crimps described above.

The tool 800 also preferably includes a tension spring 812 coupled to the base 815, a first mounting 814 coupled to the spring 812, and a second mounting 816 coupled to the lever 802. The mountings are adapted to couple with an angle bracket and a wire attached to the angle bracket. when an angle bracket and wire are coupled to the mountings and the lever is pressed down, the integrity of the coupling between the bracket and the wire will be stressed. The spring 812 preferably has a spring constant which will stress the bracket-wire coupling sufficiently to insure that the coupling will support the desired load.

According to the presently preferred embodiment, the lever 802 has two telescoping parts 807, 809 so that its length can be adjusted. A pin 803 and a plurality of holes 813*a*–913*c* lock the telescoping parts in a selected length. A soft hand grip is preferably provided at the end of the lever 802. The base 815 is preferably provided with wire guides 811, 813 to stabilize the wire during crimping. According to the presently preferred embodiment, the spring 812 is selected to provide a stress of approximately two hundred pounds to the crimp when the lever is pressed down.

The apparatus of the invention is stronger than the state of the art apparatus. Wire crimped to the bracket does not begin to stretch until a stress of approximately 420 lbs. is applied. This is about twice as strong as the looped wire and bracket combination of the prior art. According to the preferred embodiments, only about ¾" of wire is crimped to the bracket. Thus, almost eight inches of wire is saved in each assembly. Using the crimping tool of the invention, a worker can produce 2,000 wire-bracket assemblies per hour, nearly seven times the productivity of the prior art method. In addition, the methods and apparatus of the invention produce consistent results and do not rely on the integrity of the assembly worker to perform the required number of twists. Furthermore, the connection between the bracket and the wire according to the invention is a rigid connection which enhances the safety of the apparatus.

There have been described and illustrated herein several embodiments of methods and apparatus for suspending fixtures. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as so claimed.

What is claimed is:

1. A kit for suspending a fixture from a surface, said kit comprising:

a plurality of pre-cut wires having substantially the same length;

a plurality of angle brackets each having a first flange and a second flange, the first flange defining a hole adapted to receive a fastener, the second flange having structure adapted to receive an end of a wire, said structure being crimpable upon the end of the wire to secure the wire to the second flange; and a crimping tool.

2. A kit according to claim 1, wherein:

at least some of the angle brackets have fasteners pre-fit in the hole of the first flange.

3. A kit according to claim 1, wherein:

said crimping tool includes a testing apparatus for testing the integrity of the coupling of a wire crimped to an angle bracket.

* * * * *